US011517161B2

(12) United States Patent
Buschle et al.

(10) Patent No.: US 11,517,161 B2
(45) Date of Patent: Dec. 6, 2022

(54) CLEANING MACHINE WITH ROLLER HOUSING

(71) Applicant: Alfred Kärcher SE & Co. KG, Winnenden (DE)

(72) Inventors: Oliver Buschle, Schwaebisch Gmuend (DE); Roland Jeutter, Berglen (DE); Dietmar Kull, Winnenden (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 0 days.

(21) Appl. No.: 17/156,209

(22) Filed: Jan. 22, 2021

(65) Prior Publication Data

US 2021/0137330 A1 May 13, 2021

Related U.S. Application Data

(63) Continuation of application No. PCT/EP2019/069752, filed on Jul. 23, 2019.

(30) Foreign Application Priority Data

Jul. 24, 2018 (DE) ..... 10 2018 117 905.7

(51) Int. Cl.
*A47L 9/04* (2006.01)

(52) U.S. Cl.
CPC ..... *A47L 9/0477* (2013.01); *A47L 9/0411* (2013.01)

(58) Field of Classification Search
CPC ..... A47L 9/04; A47L 9/0466; A47L 9/0477; A47L 9/0411; A47L 9/06; E05C 1/00; E05C 1/002; E05C 1/02; E05C 1/04; E05C 1/06; Y10T 292/0834; Y10T 292/0844; Y10T 292/096; Y10T 292/0961;
(Continued)

(56) References Cited

U.S. PATENT DOCUMENTS 8,776,311 B2 7/2014 Genn et al.
9,924,843 B2 * 3/2018 Song ..... A47L 9/2857
(Continued)

FOREIGN PATENT DOCUMENTS

CN 204654812 9/2015
CN 106725102 5/2017
(Continued)

*Primary Examiner* — Orlando E Aviles
*Assistant Examiner* — Sidney D Hohl
(74) *Attorney, Agent, or Firm* — Womble Bond Dickinson (US) LLP

(57) ABSTRACT

A cleaning machine is provided, including at least one cleaning roller, a roller housing having a roller receptacle for the at least one cleaning roller, wherein the at least one cleaning roller is exchangeably positioned on the roller housing and the roller receptacle has an opening to the outside, a lid for closing the opening, and a locking device for fixing the lid to the roller housing, wherein at least one convex holding body is arranged on the roller housing, in that a pivotable bracket is arranged on the lid, in that at least one receptacle for the at least one holding body is arranged on the pivotable bracket, and wherein a release position of the pivotable bracket, the at least one holding body can dip into and/or exit the associated receptacle, and in a locking position, an exit of the holding body from the associated receptacle is blocked.

30 Claims, 13 Drawing Sheets

(58) Field of Classification Search
CPC ..... Y10T 292/0967; Y10T 292/102; Y10S 292/11; Y10S 292/30; Y10S 292/31; Y10S 292/63
USPC ..... 15/256.51–52, 389, 392, 256.52
See application file for complete search history.

(56) References Cited

U.S. PATENT DOCUMENTS

| | | | | |
|---|---|---|---|---|
| 2006/0064828 | A1 | 3/2006 | Stein et al. | |
| 2012/0304416 | A1 | 12/2012 | Nguyen et al. | |
| 2013/0042429 | A1 | 2/2013 | Misumi et al. | |
| 2014/0041136 | A1 | 2/2014 | Kerr et al. | |
| 2015/0265116 | A1 | 9/2015 | Genn et al. | |
| 2015/0265117 | A1* | 9/2015 | Genn | A47L 9/0411 15/363 |
| 2015/0313434 | A1* | 11/2015 | Ruffo | A47L 11/302 15/52.1 |
| 2016/0220084 | A1* | 8/2016 | Xu | A47L 9/0444 |

FOREIGN PATENT DOCUMENTS

| | | |
|---|---|---|
| CN | 106943079 | 7/2017 |
| DE | 10 2014 108 192 | 12/2015 |
| EP | 3 117 754 | 1/2017 |
| JP | 62-217930 | 9/1987 |
| JP | 2004-016605 | 1/2004 |
| JP | 2005-312589 | 11/2005 |
| JP | 2013-022228 | 2/2013 |
| JP | 2013-022277 | 2/2013 |
| JP | 2013-027558 | 2/2013 |
| JP | 2013-031508 | 2/2013 |
| JP | 2015-146958 | 8/2015 |
| WO | WO 01/41618 | 6/2001 |

* cited by examiner

CLEANING MACHINE WITH ROLLER HOUSING

CROSS-REFERENCE TO RELATED APPLICATIONS

This application is a continuation of international application number PCT/EP2019/069752, filed Jul. 23, 2019, which claims the benefit of German application number 10 2018 117 905.7, filed Jul. 24, 2018, which are incorporated herein by reference in their entirety and for all purposes.

BACKGROUND OF THE INVENTION

The invention relates to a cleaning machine, comprising at least one cleaning roller, a roller housing having a roller receptacle for the at least one cleaning roller, wherein the at least one cleaning roller is exchangeably positioned on the roller housing and the roller receptacle has an opening to the outside, a lid for closing the opening, and a locking device for fixing the lid to the roller housing.

Alfred Kärcher Vertriebs-GmbH, 71364 Winnenden sells carpet brush vacuum cleaners under the name CV, which comprise a roller housing for a cleaning roller.

Cleaning rollers and/or cleaning machines with cleaning rollers are known e.g. from US 2006/0064828 A1, CN 106943079 A, CN 204654812 U, EP 3 117 754 A1, JP 62-217930, JP 2005312589 A, JP 2013-022228 A, JP 2013-022277 A, JP 2013-027558 A, JP 2013-031508 A, JP 2015-146958 A, US 2012/0304416 A1, US 2013/0042429 A1, US 2014/0041136 A1, US 2015/0265116 A1, US 2015/0265117 A1, or WO 01/41618 A1.

U.S. Pat. No. 8,776,311 B2 discloses a cleaning head for a vacuum cleaner, the cleaning head having a housing in which a hollow brush rod is rotatably arranged.

JP 2013-022277 A discloses a floor suction nozzle for a vacuum cleaner.

JP 2005-312589 A discloses a suction tool for a vacuum cleaner.

DE 10 2014 108 192 A1 discloses a vacuum cleaner with a filter that is removable from the vacuum cleaner.

SUMMARY OF THE INVENTION

In accordance with an embodiment of the invention, a cleaning machine is provided, in which an exchange of the cleaning roller on the roller housing is possible in a simple manner.

In accordance with an embodiment of the invention, provision is made in the cleaning machine stated that at least one convex holding body is arranged on the roller housing, that a pivotable bracket is arranged on the lid, that at least one receptacle for the at least one holding body is arranged on the pivotable bracket, and that in a release position of the pivotable bracket, the at least one holding body is able to dip into the associated receptacle and/or exit the associated receptacle, and in a locking position of the pivotable bracket, an exit of the holding body from the associated receptacle is blocked.

In accordance with an embodiment of the invention, the lid can be fixed to the roller housing and released therefrom in a simple manner and in particular without tools. The number of components required is minimized.

This results in a simple operability for the user; by pivoting the pivotable bracket with the at least one receptacle, same can bring the lid from the locking position into a release position or vice versa from the release position into a locking position.

The measures to the roller housing for fixing the lid can be performed in a constructively simple manner. The locking can be achieved only with the at least one convex holding body.

It is favorable if the at least one convex holding body is configured as a retaining ball (retaining sphere). A locking can thus be achieved in a simple manner. Further, a transition between a release position and a locking position and between a locking position and a release position can be achieved in a simple manner. A rotary bearing can be provided by way of a retaining ball arranged on a receptacle.

It is favorable if the at least one receptacle has a receiving space for the associated holding body. The corresponding convex holding body, in particular in spherical form, can be positioned in the receiving space. Depending on the position of the receptacle, an exit or dipping-in can be achieved or such an exit can be blocked.

The receiving space favorably has a spherical delimitation. As a result, a sort of ball bearing for the holding body is provided in the receptacle; the release position can be easily reached from the locking position.

It is particularly advantageous if the receiving space has a first opening and a second opening, wherein the holding body is able to pass through the first opening and the holding body is not able to pass through the second opening. The relative position of the first opening and the second opening to the roller housing is predetermined by a pivotal position of the pivotable bracket. The holding body can then be brought into the associated receiving space through the first opening in a simple manner. By pivoting the bracket, the receiving space can be positioned with the second opening such that an exit of the holding body is blocked.

In particular, the holding body sits on a neck, wherein in the locking position, the neck is positioned in the second opening. The holding body has larger width dimensions than the neck. The neck is a sort of ball neck. By being positioned in the second opening, an exit of the holding body from the corresponding receiving space can be blocked in a simple manner. This blocking can be released in a simple manner by pivoting the corresponding receptacle.

In particular, provision is made that by pivoting the pivotable bracket from the release position into the locking position when the holding body is positioned in the receiving space, the neck is positioned in the second opening. A blocking for the exit of the corresponding holding body from the associated receiving space can thus be achieved in a simple manner.

It is favorable if the first the opening and the second opening are connected to one another. A transition between the release position and the locking position and vice versa can thereby be achieved in a simple manner by a pivotal movement of the pivotable bracket.

In one embodiment, at least one first convex holding body and, spaced at a distance from the first holding body, a second convex holding body are arranged on the roller housing, and a first receptacle for the first holding body and a second receptacle for the second holding body are arranged on the pivotable bracket. A locking of the lid to the roller housing on at least two points can thereby be achieved. A good closure of the roller receptacle on the roller housing can thus be achieved.

In particular, a pivot bearing for a pivotability of the pivotable bracket is arranged between the first receptacle and the second receptacle. This results in a compact structure for the roller housing and the lid. The number of components required can be kept small.

In one embodiment, in the release position, the pivotable bracket is oriented transversely and in particular perpendicularly to the lid. As a result, a release position can be reached in a simple manner by pivoting into this transverse position.

It is favorable if in the locking position, the pivotable bracket is oriented at least approximately parallel to the lid. As a result, it projects only minimally beyond the lid or not at all. In the locking position, a working position for the cleaning machine is reached.

In one embodiment, a recess for accommodating the pivotable bracket in the locking position is arranged on the lid, and, in particular, when the pivotable bracket is arranged in the recess, said bracket does not project beyond a surface of the lid. As a result, in the locking position, the bracket can be arranged recessed on the lid.

It is favorable if a dipping-in direction and/or an exit direction of the at least one holding body for the associated receptacle is oriented transversely and in particular perpendicularly to a pivot axis of the pivotable bracket. This results in a simple constructive design. Further, it results in a simple operability.

In one embodiment, a pivot angle of the pivotable bracket between the release position and the locking position is in the range between 70° and 110° and in particular is at least approximately 90°. A transition between the release position and the locking position and vice versa can thus be achieved in a simple manner by pivoting the pivotal bracket.

In one embodiment, the pivotable bracket has a first region at which a first receptacle is arranged, and has a second region at which a second receptacle is arranged, and has a third region which is located between the first region and the second region. For example, a gripping region for gripping the bracket for a pivotal movement can be formed by way of the third region. This results in a compact structure with optimized use of space.

In particular, the third region is configured as an arc. It can thereby be gripped in a simple manner. This results in an optimized use of space on the lid.

It is further favorable is a pivot bearing is arranged or formed at the first region and/or the second region. The corresponding locking device can thereby be formed in a constructively simple and space-optimized manner.

In one embodiment, a drive motor is provided for a rotary drive of the at least one cleaning roller, wherein, in particular, the drive motor is arranged on the roller housing. It is also possible in principle for a displacement, by the operator, of the roller housing over surface to be cleaned to drive a rotational movement of the at least one cleaning roller.

It is favorable if a bearing for the at least one cleaning roller is arranged on the lid for rotatably mounting the at least one cleaning roller. A support of the at least one cleaning roller in the roller housing and on the lid can thereby be achieved. In particular, a two-point mounting for the at least one cleaning roller in the roller housing can thus be achieved.

Provision is made for the lid to cover the at least one holding body towards the outside when the lid is fixed in the roller housing. This results in an optimized covering.

It is favorable if the lid is completely removable from the roller housing, and, in particular, the at least one cleaning roller is releasable from the lid. An exchange of a cleaning roller can thus be performed in a simple manner.

In one embodiment, the roller housing has an end wall associated with the roller receptacle, wherein the opening is formed on the end wall, and wherein the at least one convex holding body is arranged on the end wall. This results in a constructively simple and compact design of the roller housing. The lid can be locked to the roller housing in a simple manner.

In particular, at least one of the following is provided:

- a pivot axis of the pivotable bracket is arranged transversely and in particular perpendicularly to a rotational axis of the at least one cleaning roller;
- a pivot axis of the pivotal bracket is arranged at an acute angle to a (lower) envelope plane of the roller housing.

This results in a compact structure. The lid can be locked to the roller housing or removed therefrom in a simple manner.

It is favorable if the roller receptacle has an opening towards an envelope plane (towards a lower envelope plane) of the roller housing. This opening is, in particular, a suction opening or suction mouth on the roller housing.

In one embodiment, a locking device for releasably locking the at least one cleaning roller to the lid is provided. It is thereby possible, when the lid is locked to the at least one cleaning roller, to remove the corresponding cleaning roller from the roller receptacle with the lid and also by means of the lid. Further, the cleaning roller can be inserted by way of the lid. Thus, this results in a simple exchangeability, i.e. an automatic alignment can be achieved. The removal or insertion of the cleaning roller can thereby be simplified.

It is favorable if the locking device is configured for an axial locking between the lid and the at least one cleaning roller, and in particular enables a rotation between the at least one cleaning roller and the lid. This results in a simple operability.

In one embodiment, the locking device comprises a pin, which is arranged on the at least one cleaning roller, and comprises a movable slider, which is arranged on the lid, wherein when the slider is in locking engagement with the pin, an axial locking between the lid and the at least one cleaning roller is present. The axial locking enables, in particular, a rotation of the at least one cleaning roller relative to the lid. An axial locking can thus be achieved in a simple manner, which is releasable in a simple manner.

The at least one cleaning roller is e.g. a brush roller and/or textile roller. It is possible for a textile covering and brush arrangement to be combined on a cleaning roller. In one embodiment, the cleaning roller is configured as a carpet brush.

In one embodiment, the cleaning machine is configured as a floor cleaning machine and, in particular, as a suction machine and, in particular, carpet brush vacuum cleaner.

It is then favorable if at least one suction opening is formed on the roller receptacle. Dirt can be sucked in via said suction opening. The roller receptacle is then also in fluidic connection with a suction blower device.

The subsequent description of preferred embodiments serves in conjunction with the drawings for further explanation of the invention.

Figure 1:
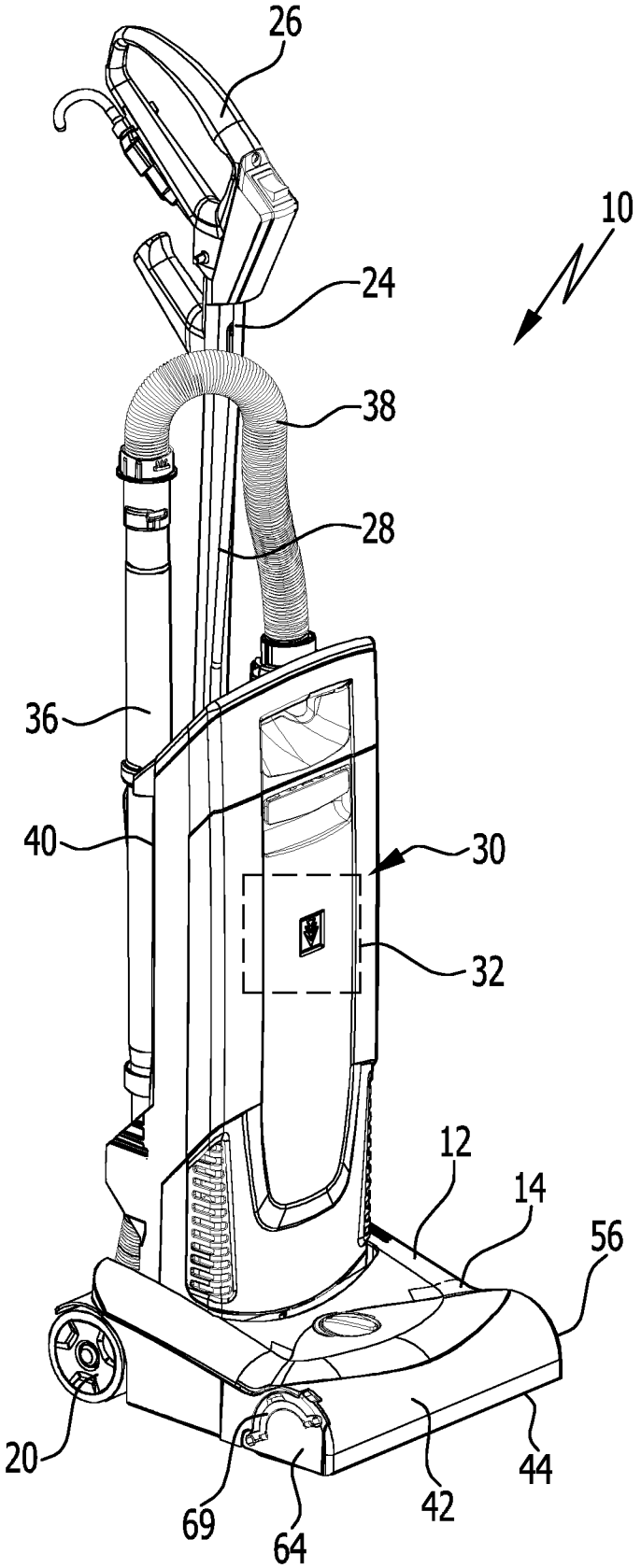
FIG. 1 shows a perspective depiction of an embodiment of a cleaning machine in accordance with the invention.

An embodiment of a cleaning machine 10 in accordance with the invention is a brush suction machine (carpet brush vacuum cleaner), which is shown in FIG. 1 in a perspective depiction.

DETAILED DESCRIPTION OF THE INVENTION

The cleaning machine 10 comprises a floor head 12 with a roller housing 14.

Figure 2:
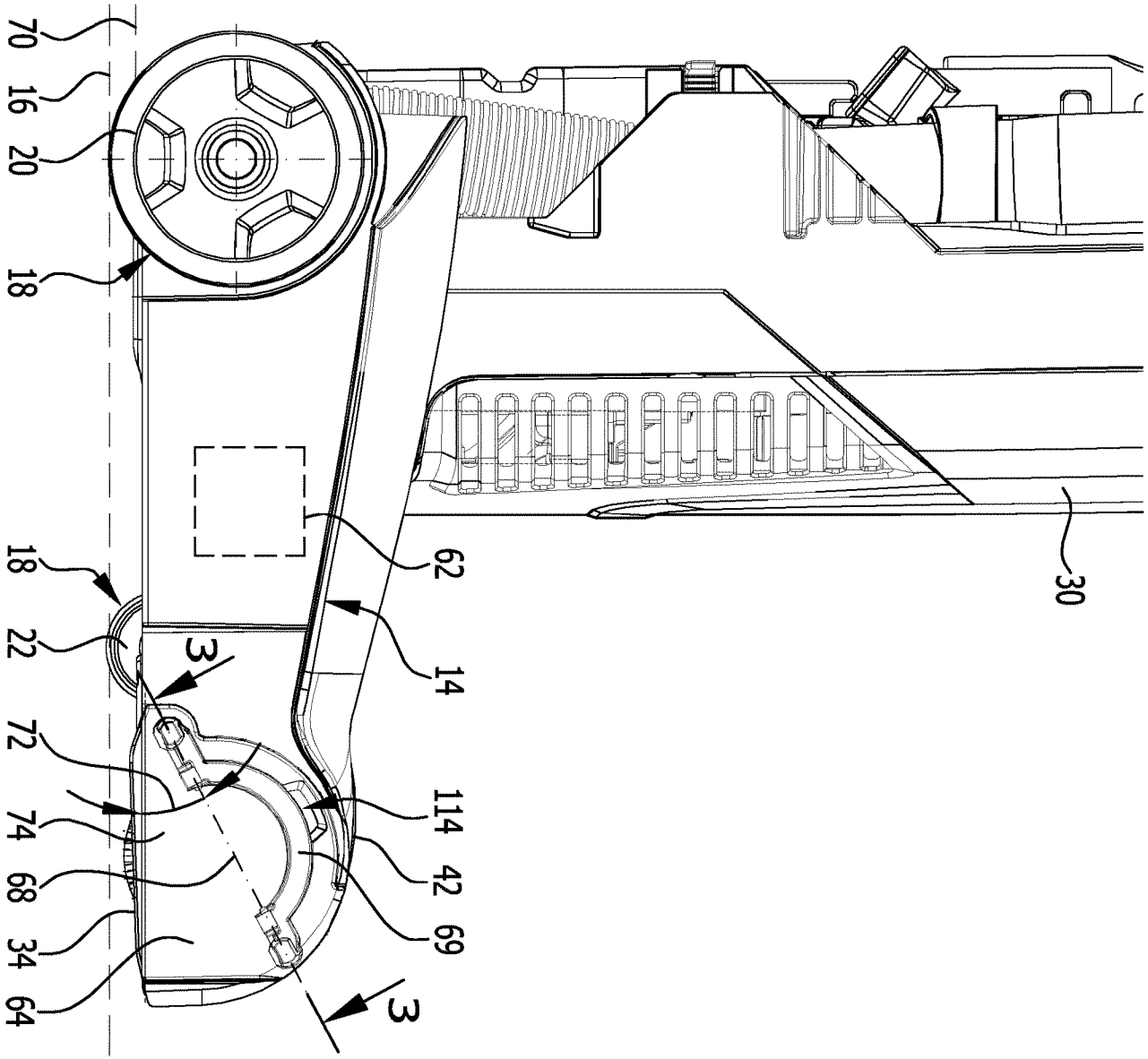
FIG. 2 shows a partial side view of the cleaning machine in accordance with FIG. 1, wherein a lid is locked to a roller housing.

The floor head 12 is supportable on a surface 16 to be cleaned (cf. FIG. 2) by way of a wheel device 18.

In one embodiment, the wheel device 18 comprises wheels 20 with, in particular, a left rear wheel and a right rear wheel. The wheels 20 are arranged in the region of a rear end of the floor head 12.

Further, one or more rolling devices 22 are arranged on the floor head at a distance from the wheels 20.

The cleaning machine 10 comprises a holding rod device 24, on which a handle 26 is arranged at a proximal end. By way of the handle 26, an operator, while standing, can guide the cleaning machine 10 over the surface 16 to be cleaned.

In one embodiment, the holding rod device 24 comprises one single holding rod 28. A housing 30 is arranged on said holding rod 28. A suction blower device 32 is positioned in the housing 30. The suction blower device 32 comprises a blower motor, which, in particular, is an electric motor, and a corresponding blower device with one or more impellers.

The housing 30 or the holding rod device 24 is connected to the floor head 12 and, in particular, pivotably connected in such a way that the holding rod device 24 is pivotable about a pivot axis relative to the floor head 12 when the floor head 12 is supported on the surface 16 to be cleaned. Said pivot axis is then at least approximately parallel to the surface 16 to be cleaned.

At least one suction mouth 34 is formed on the roller housing 14. Said suction mouth 34 is in fluidic connection with the suction blower device 32.

In one embodiment, the cleaning machine 10 further has a suction pipe 36 on which, in particular, a suction nozzle sits or is positionable. The suction pipe 36 is in fluidic connection with the suction blower device 32 by means of an, in particular flexible, suction hose 38.

A holder 40 for the suction pipe 36 is arranged on the housing 30.

By way of the suction pipe 36, when same is removed from the holder 40, a user can perform a suctioning separately from the suction opening 34.

The roller housing 14 has a roller receptacle 42. The roller receptacle 42 is arranged in the region of a front end 44 of the floor head 12 (the roller housing 14), which faces away from the end at which the wheels 20 are arranged.

The roller receptacle 42 is open at the suction mouth 34. Otherwise it is closed.

The roller receptacle 42 (cf. e.g. FIG. 12) serves to accommodate a cleaning roller 46.

In one embodiment of a brush suction machine, the cleaning roller 46 is a brush roller with a bristle arrangement 48. The bristle arrangement 48 is arranged, in particular, such that the cleaning roller 46 acts as a carpet brush.

It is also possible in principle for the cleaning roller 46 to be a textile roller, or for the cleaning roller 46 to be a combination of a textile roller and brush roller.

Figure 3:
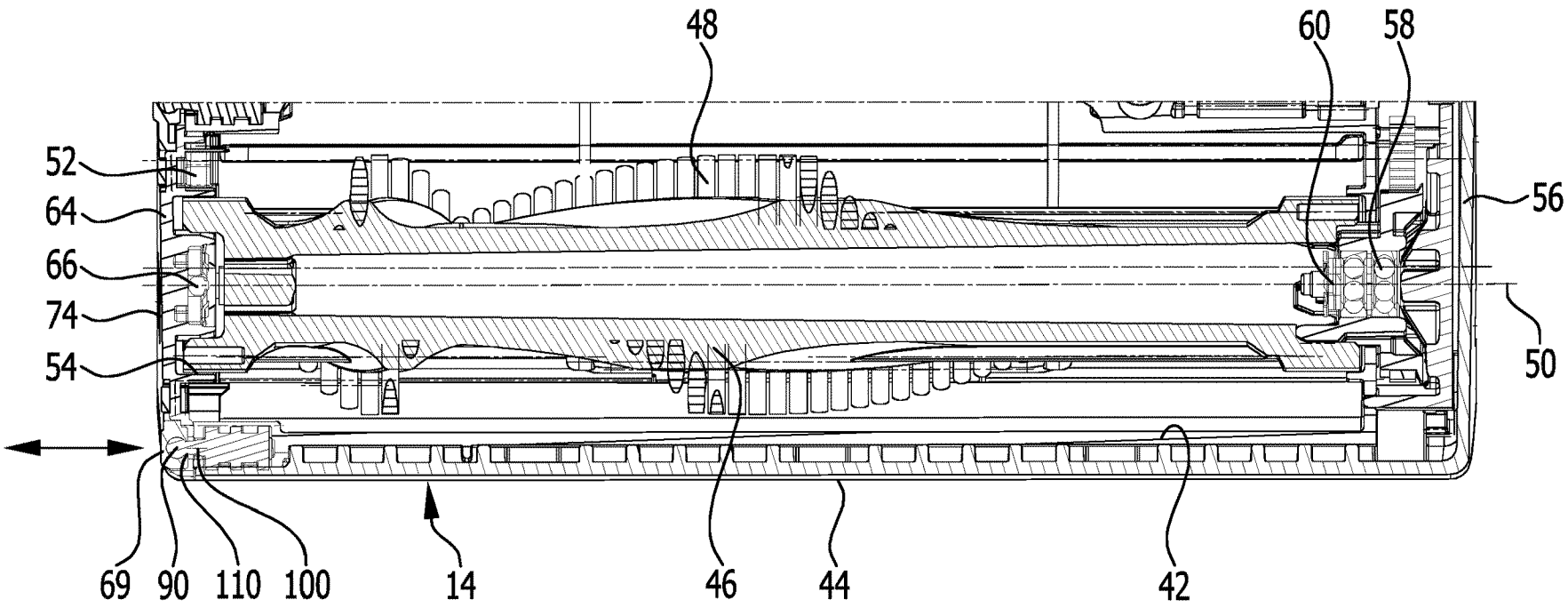
FIG. 3 shows a sectional view along line 3-3 in accordance with FIG. 2.
Figure 12:
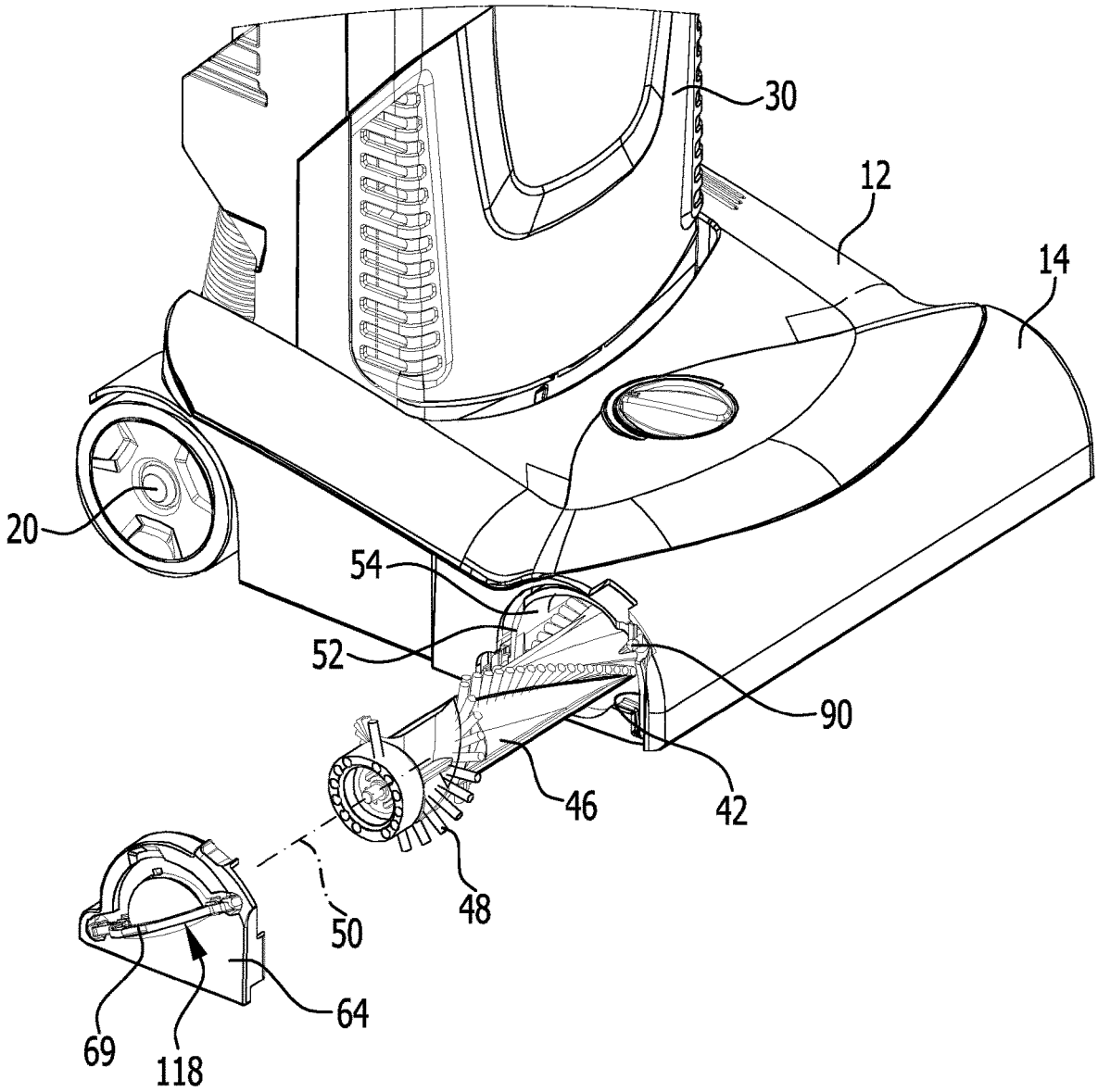
FIG. 12 shows schematically the cleaning machine in accordance with FIG. 1 in a partial depiction with the lid released from the roller housing and the cleaning roller partially removed from a roller receptacle.
Figure 13:
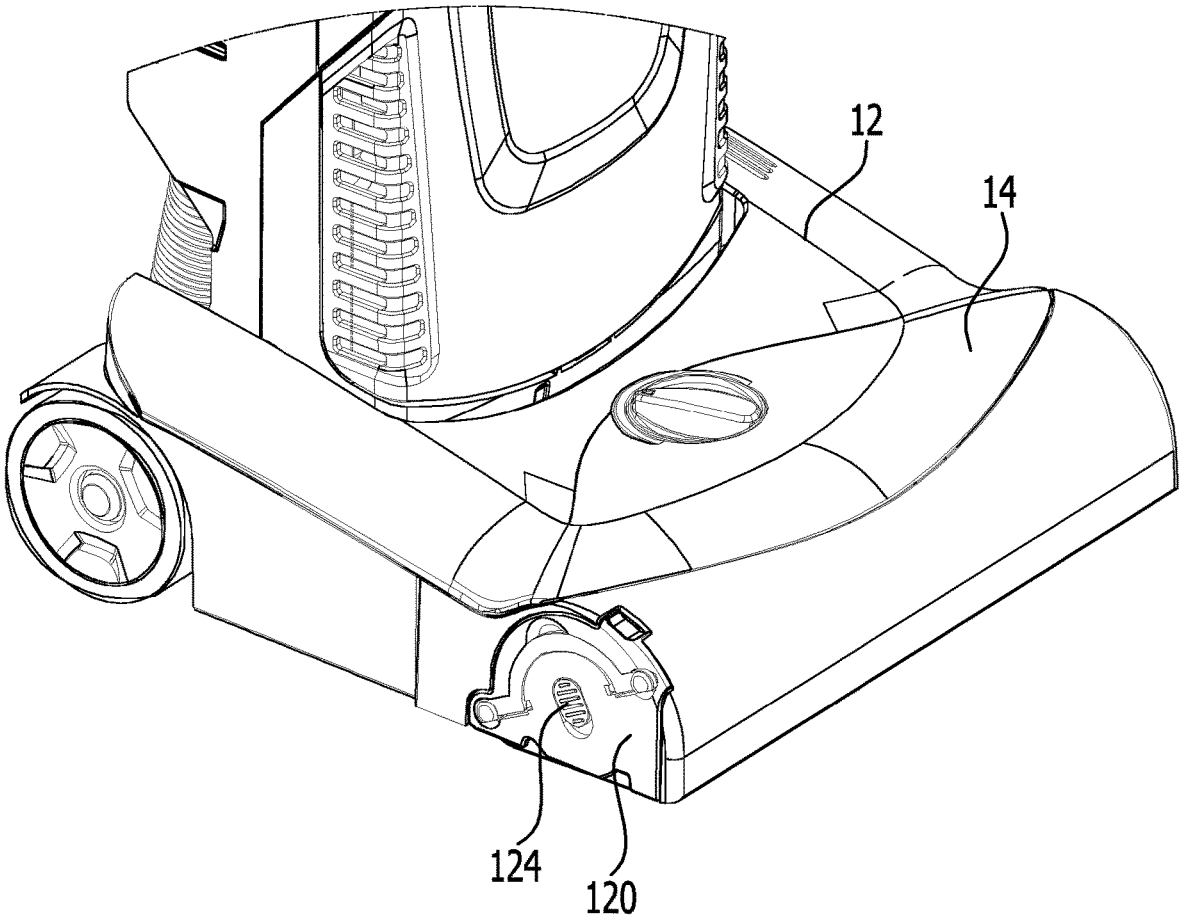
FIG. 13 shows a perspective partial view of a further embodiment of a cleaning machine in accordance with the invention with a lid in a locking position on a roller housing.

The cleaning roller, when it is positioned and fixed in the roller housing 14 and thereby in the roller receptacle 42, is rotatable about a rotational axis 50 (cf. e.g. FIGS. 3 and 12).

The rotational axis 50 is at least approximately parallel to the surface 16 to be cleaned when the floor head 12 is placed on said surface 16, supported by way of the wheel device, in the intended manner.

Figure 8:
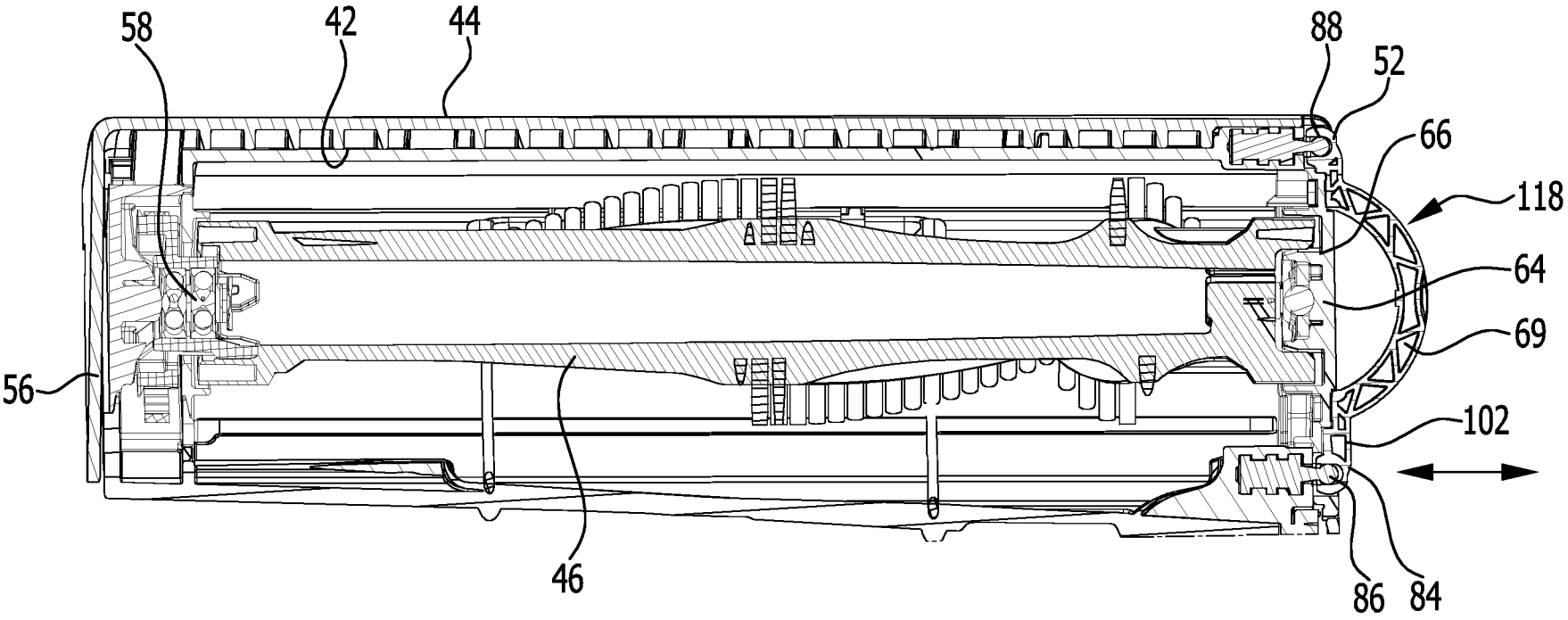
FIG. 8 shows a side view along line 8-8 in accordance with FIG. 7.
Figure 9:
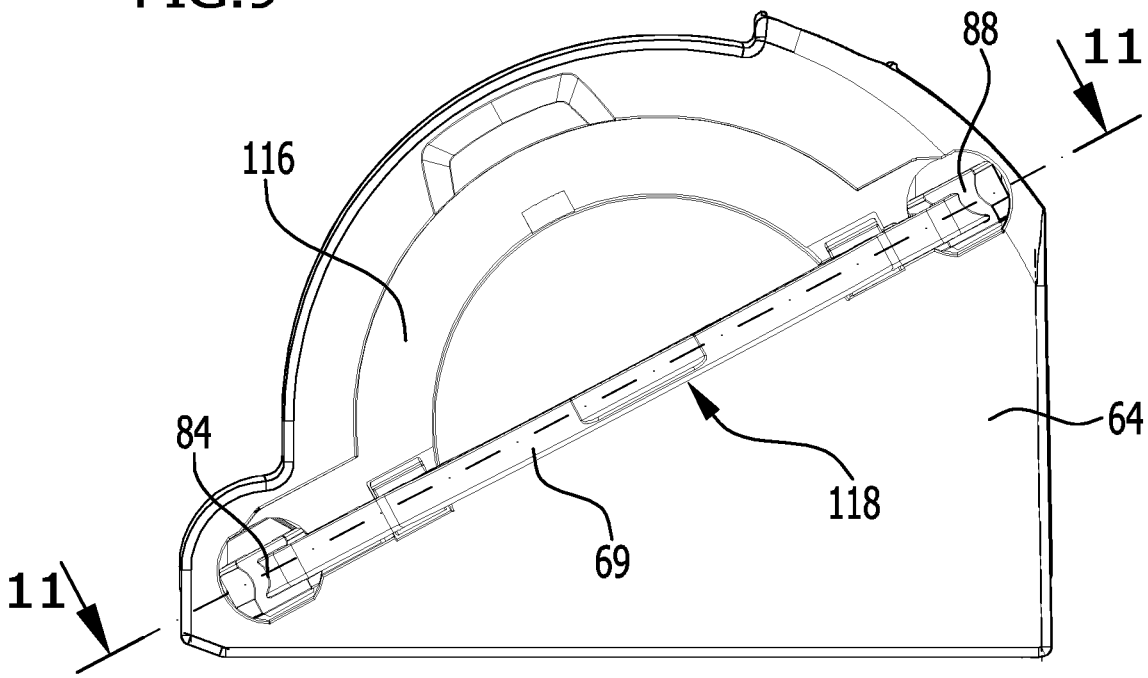
FIG. 9 shows the lid for the roller housing in the release position in accordance with 7 in an outside view.

An end wall 52 on the roller housing 14 is associated with the roller receptacle 42 (cf. FIGS. 3, 8, 12).

An opening 54 is formed in said end wall 52. The opening 54 is an opening of the roller receptacle 42.

The cleaning roller 46 is brought into the roller receptacle 42 through this opening 54 and the cleaning roller 46 is removable from the roller receptacle 42 and thus the floor head 12 through the opening 54.

Further, opposite the opening 54, a wall 56, which is closed, is associated with the roller receptacle 42. The wall 56 is a side wall of the roller housing 14. A rotary bearing 58 for the cleaning roller 46 is arranged on this wall 56. The cleaning roller 46 has a counter element 60 for this rotary bearing 58. By means of the counter element 60, in particular, the cleaning roller 46 is slidable onto the rotary bearing 58.

In one embodiment, provision is made for a drive motor 62 to be arranged in the roller housing 14 for rotatively moving the cleaning roller 46. The drive motor 62 acts on the cleaning roller 46, for example, by way of a belt drive and drives said cleaning roller 46 in its rotational movement. For example, the drive motor 62 acts on the rotary bearing 58 in order to bring about a corresponding rotation, and by way of the counter element 60, the cleaning roller 46 can be non-rotatably connected to the rotary bearing 58.

A lid 64 is provided for closing the opening 54.

A rotary bearing 66 is arranged on the lid 64. When the opening 54 is closed with the lid 64, the rotary bearing 66 then supports the cleaning roller 46 on the lid 64 so as to be rotatable about the rotational axis 50.

The lid 64 is removable as a whole from the roller housing 14 and is a part separate from the roller housing 14, which is fixable to the roller housing 14.

The lid 64 is adapted in its shape to the opening 54.

A bracket 69 sits on the lid 64 so as to be pivotable about a pivot axis 68.

The pivot axis 68 is oriented transversely and in particular perpendicularly in relation to the rotational axis 50. In relation to a lower envelope plane 70 of the roller housing 14 (cf. FIG. 2), wherein, in particular, the lower envelope plane 70 is in relation to the roller housing 14 without a wheel device 18, and which is aligned at least approximately parallel to the surface 16 to be cleaned when the floor head 12 is positioned relative to said surface 16 in the intended manner, the pivot axis 68 is at an acute angle 72 (cf. FIG. 2). This acute angle is, for example, on the order of about 30° and in particular in the range between 20° and 40°.

The bracket 69 is arranged on an outside 74 of the lid 64.

The rotary bearing 66 is arranged on an inside 76 of the lid 64 opposite the outside 74.

Figure 4:
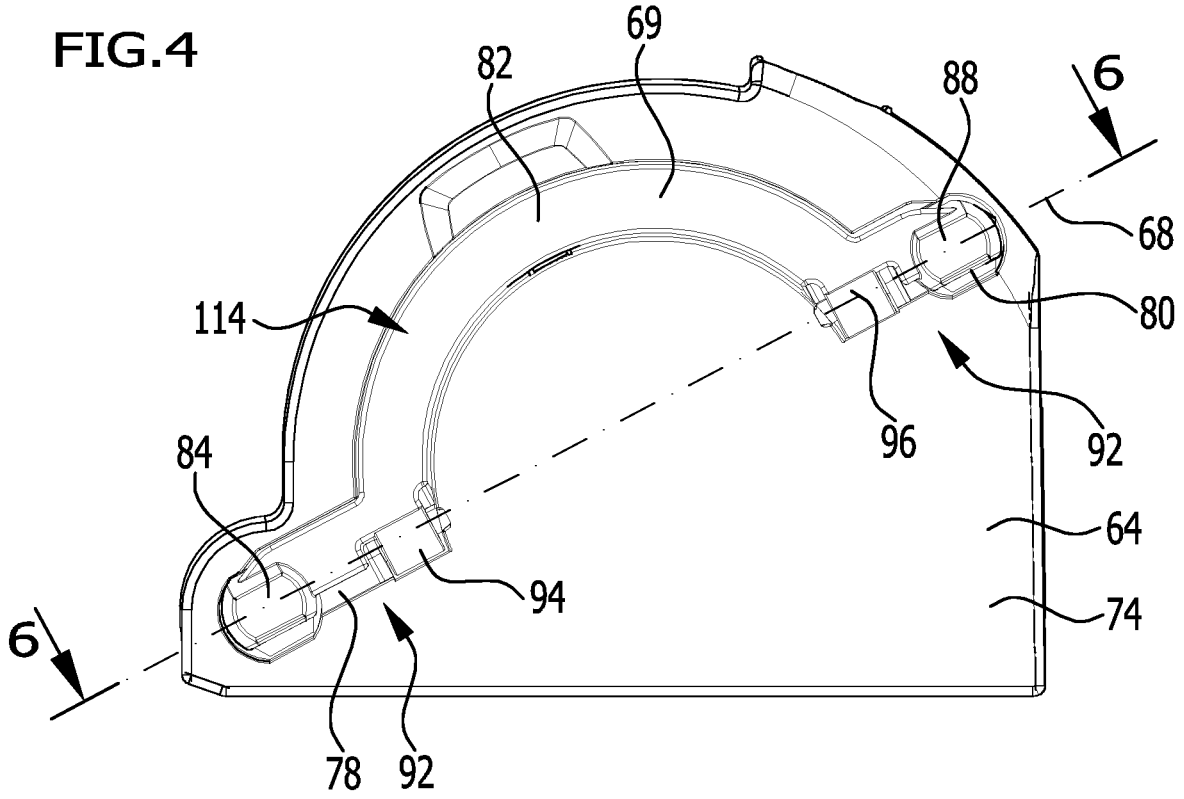
FIG. 4 shows as a separate element the lid of the cleaning machine in accordance with FIG. 1 in an outside view in a locking position of a bracket.

The bracket 69 has (cf. e.g. FIG. 4) a first region 78 and a second region 80 spaced at a distance from the first region 78. The first region 78 and the second region 80 are of at least approximately rectilinear configuration.

A third region 82, which is of arcuate configuration, is formed between the first region 78 and the second region 80.

Seated at the first region 78 is a first receptacle 84 for a first convex holding body 86 of the roller housing 14.

Seated at the second region 80 at a distance from the first receptacle 84 is a second receptacle 88 for a second convex holding body 90 of the roller housing 14.

The first receptacle 84 and the second receptacle 88 are non-rotatably arranged on the bracket 69. When pivoting the bracket 69, the first receptacle 84 and the second receptacle 88 are pivoted together therewith.

The bracket 69 is held on the lid 64 by way of a pivot bearing 92. The pivot bearing 92 comprises a first bearing region 94, which sits at the first region 78, and a second bearing region 96, which sits at the second region 80 of the bracket 69. The first bearing region 94 and the second bearing region 96 are spaced at a distance from one another. Arranged between them is the third region 82 of the bracket 69.

The first receptacle 84 and the second receptacle 88 are located on a line that is predetermined by the pivot axis 68.

Figure 11:
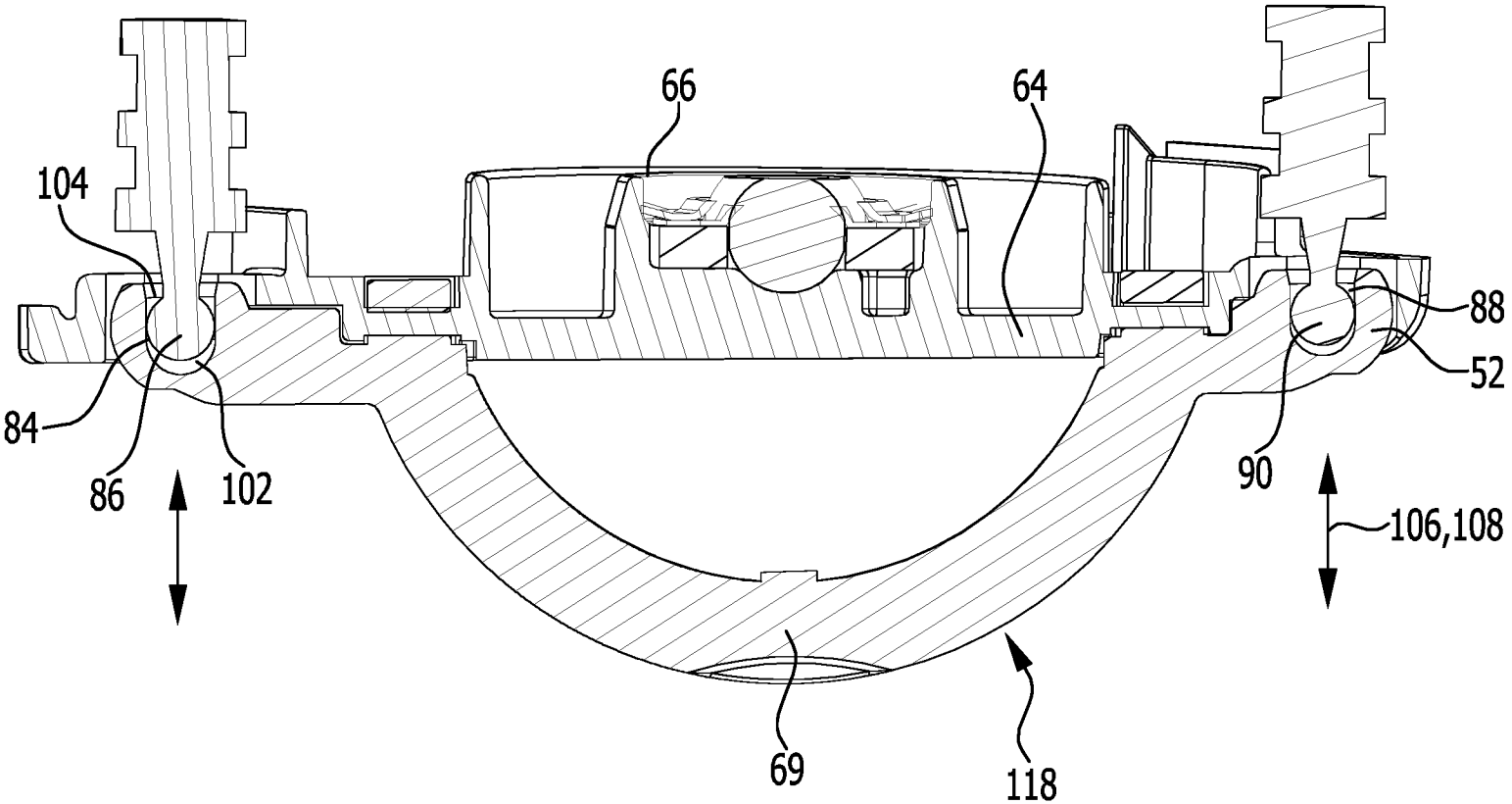
FIG. 11 shows a sectional view along line 11-11 in accordance with FIG. 9, a portion of the roller housing also being shown.

The first holding body 86 (cf. FIGS. 6, 11, 14) is of convex configuration and in particular is configured as a ball. It sits on the end wall 52 by way of a first neck 98. The second holding body 90 is also of convex configuration and in particular is configured as a retaining ball. It sits on the end wall 52 at a distance from the holding body 86 by way a second neck 100. The opening 54 is located between the first holding body 86 and the second holding body 90.

The first receptacle 84 and the second receptacle 88 each comprise a receiving space 102 for the associated holding body 86 and 90, respectively (cf. FIG. 5, 6, 8, 10, 11).

Figure 10:
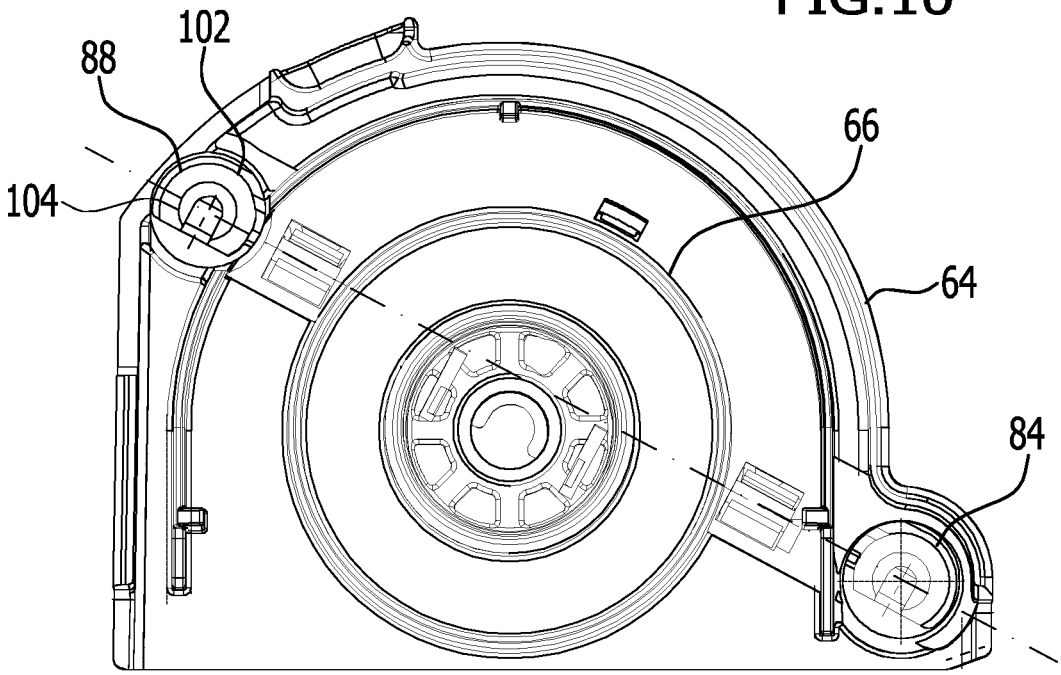
FIG. 10 shows the lid in accordance with FIG. 9 in a view in the opposite direction to the view shown in FIG. 9.

The receiving space 102 has a first opening 104 (FIGS. 10, 11), through which the associated first holding body 86 or the second holding body 90 is able to pass. The corresponding holding body 86 or 90 is brought in an insertion direction 106 through said opening 104 into the receiving space 102. Further, the corresponding holding body 86, 90 is able to exit the receiving space 102 through this first opening 104 in an exit direction 108, which is an opposite direction to the insertion direction 106.

Figure 5:
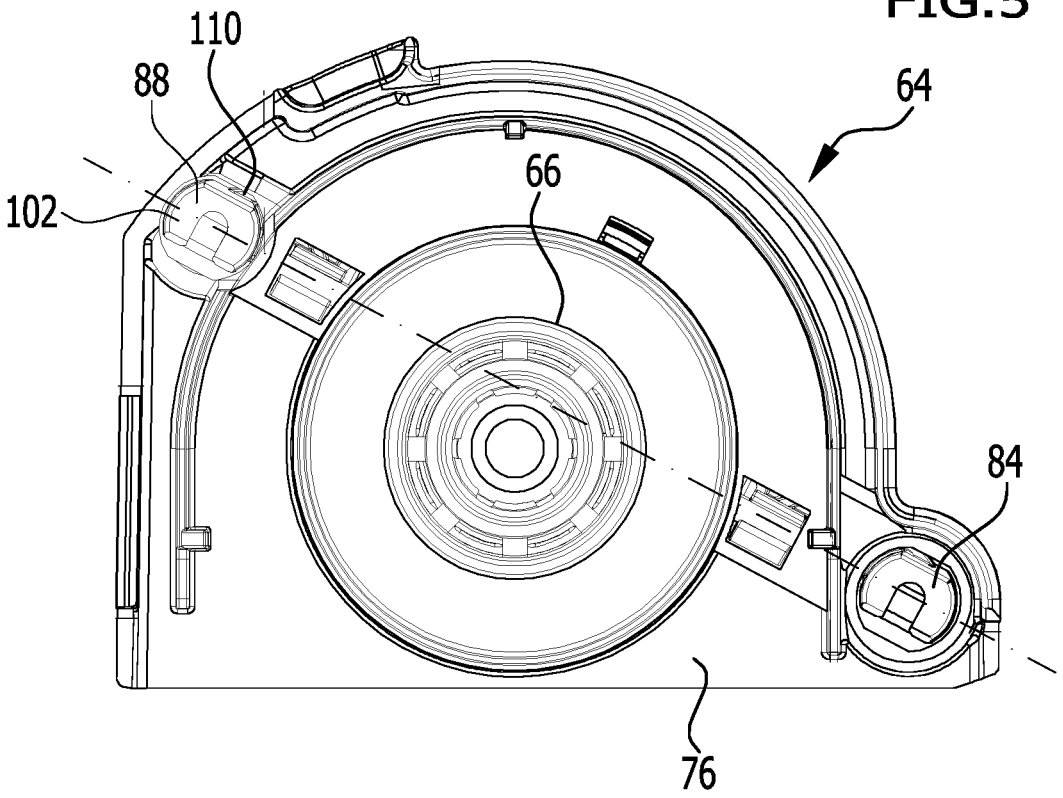
FIG. 5 shows a further view of the lid in accordance with FIG. 4 from another side.
Figure 6:
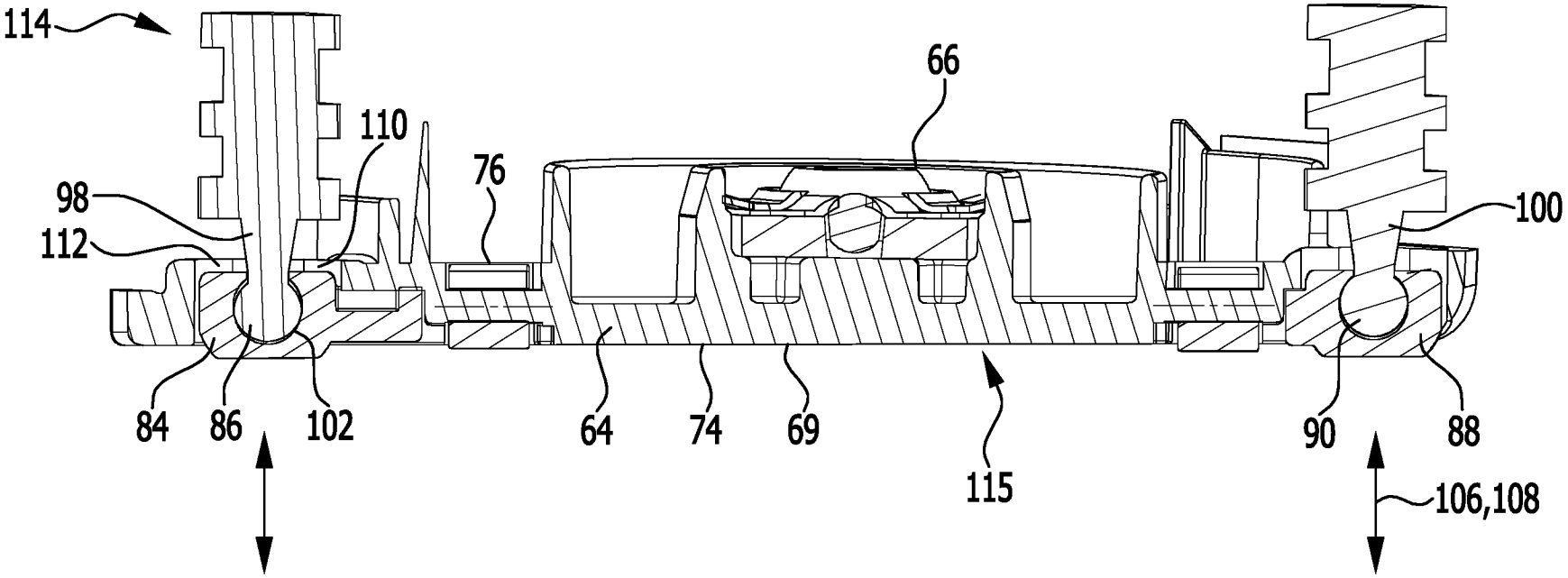
FIG. 6 shows a sectional view along line 6-6 in accordance with FIG. 4, a portion of the roller housing also being shown.
Figure 7:
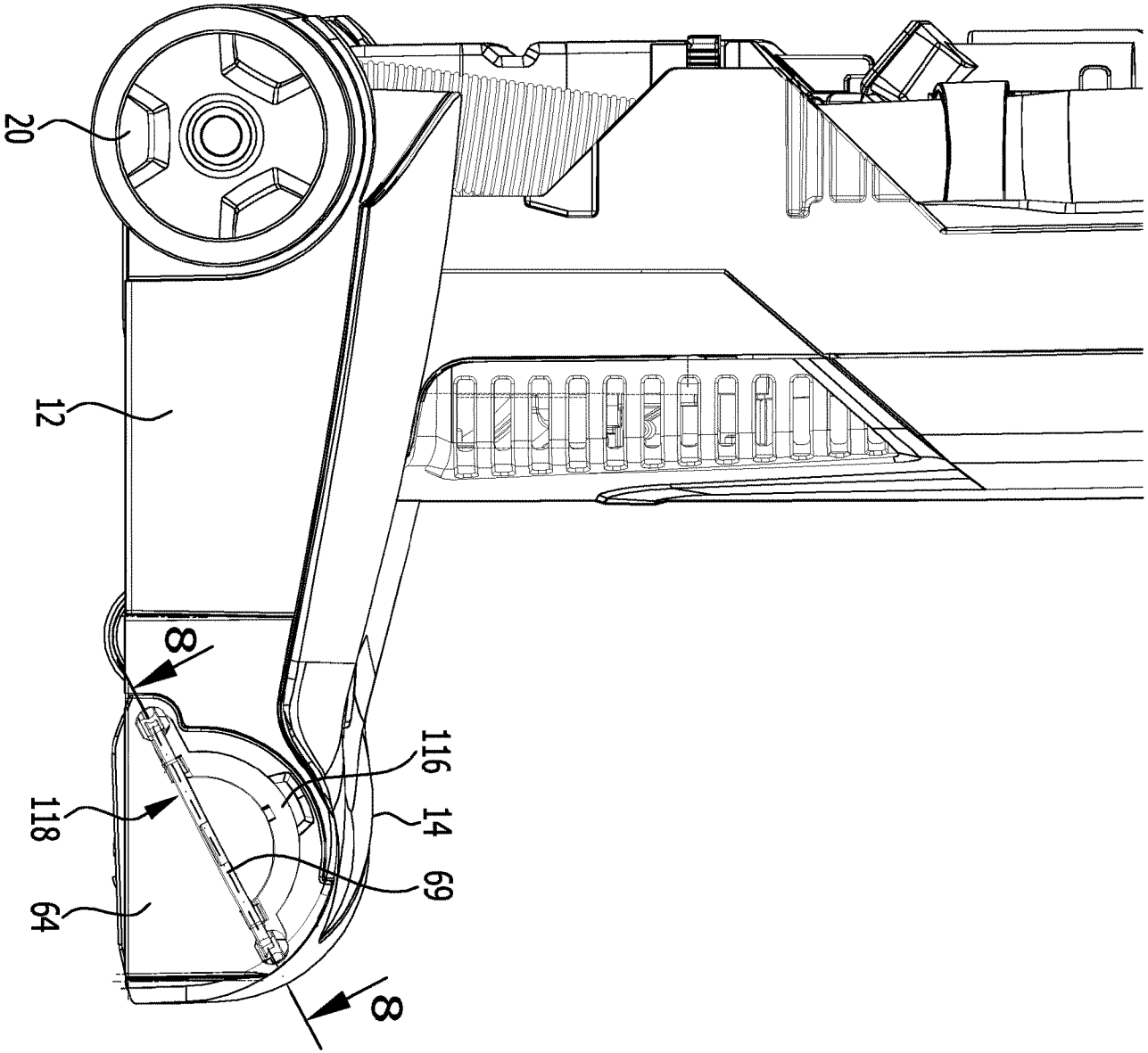
FIG. 7 shows the same view as FIG. 2 with a release position of the bracket.

The receiving space 102 further has a second opening 110 (FIGS. 3, 5, 6). The second opening 110 is, in particular, connected to the first opening 104.

The second opening 110 is configured such that it is not able to be passed through by a holding body 86 or 90 positioned in the corresponding receiving space 102. Formed around the second opening 110 is a wall 112 of the corresponding receptacle 84, 88, which is a blocking wall for the exit of the corresponding holding body 86, 90 in the exit direction 108 (cf. in particular FIG. 6).

The second opening 110 is thereby configured such that the corresponding neck 98, 100 is positionable therein.

By pivoting the bracket 69, the corresponding receptacle 84, 88 can thereby be positioned such that the corresponding neck 98 and 100, respectively, is located in the second opening 110. In this position of the bracket 69, which is a locking position 114, the lid 64 can be (releasably) fixed to the roller housing 14 on the end wall 52 by way of the holding bodies 86, 90.

The receptacles 84, 88 form with the holding bodies 86, 90 and the bracket 69 a locking device 115 for fixing the lid 64 to the roller housing 14.

In particular, the receiving space 102 is delimited by an at least partially spherical wall. This enables a (supported) rotation of the corresponding receptacle 84 or 88 about the pivot axis 68 with the holding body 86 or 90 positioned in the receiving space 102. The receiving space 102 forms a socket, wherein a relative rotation to the roller housing 14 is possible by pivoting the bracket 69 about the pivot axis 68.

In the locking position 114 of the bracket 69 (FIGS. 1 to 6), said bracket 69 is pivoted relative to the lid 64 such that, when the holding bodies 86 and 90 are seated in the respective receiving spaces, the respective first neck 98 or 100 is seated in the second opening 110 and thus the corresponding blocking effect is achieved, which blocks a removal of the lid 64 from the roller housing 14; the lid 64 cannot be removed from the roller housing 14 in the exit direction 108.

Formed on the lid 64 on the outside 74 is a recess 116 which is adapted to the shape of the bracket 69 with its first region 78, its second region 80, and its third region 82. The recess 116 is configured as a trough; it forms a depression on the outside 74 of the lid 64.

In the locking position 114 of the pivotable bracket 69, the bracket 69 is positioned in the recess 116. The recess 116 is thereby configured, in particular, such that the bracket cannot project beyond said recess 116. A recessed arrangement of the bracket 69 in the locking position 114 can thus be achieved.

The bracket 69 further has a release position 118 (FIGS. 7 to 12).

In the release position 118, the bracket 69 is pivoted with its first receptacle 84 and its second receptacle 88 such that the respective first opening 104 of the first receptacle 84 or the second receptacle 88 is in such a position that the respective first holding body 86 or second holding body 90 is able to pass through the first opening 104 in the exit direction 108 and thus is able to exit the corresponding receptacle space 102. The lid 64 can thereby be removed from the roller housing 14.

The release position 118 is a pivotal position relative to the locking position 114. For example, a pivot angle between the locking position 114 and the release position 118 is about 90°.

In the release position 118 the bracket 69 projects transversely and in particular perpendicularly away from the outside 74 of the lid 64.

An insertion or exchange of the cleaning roller 46 on the floor head 12 functions as follows:

Commencing from the locking position 114 of the bracket 69 (FIGS. 1 to 6), the lid 64 is locked to the roller housing 14. The bracket 69 is arranged recessed in the recess 116.

The respective holding bodies 86, 90 are positioned at their associated receptacles 84 and 88, respectively, in the respective receiving space 102. The lid 64 thereby covers the holding bodies 86, 90 towards the outside.

The respective first neck 98 of the first holding body 86 and the second neck 100 of the second holding body 90 is positioned in the second opening 110. The wall 112 blocks an exit of the respective holding body 86, 90 from the corresponding receiving space 102 in the exit direction 108.

The exit direction 108 is, in particular, at least approximately parallel to the rotational axis 50.

The cleaning roller 46 is rotatably supported on the lid 64 by way of the rotary bearing 66.

For removing the cleaning roller 46 from the roller receptacle 42, the bracket 69 is pivoted from the locking position 114 into the release position 118. It is thereby taken from the recess 116 and, for example, pivoted by a pivot angle of 90° (FIGS. 7 to 12).

By pivoting the bracket 69, the first receptacle 84 and the second receptacle 88 are pivoted together with the bracket. The openings 104, 110 are thereby also pivoted.

In the release position 118 the respective first opening 104 of the first receptacle 84 and the second receptacle 88 are then positioned such that the holding bodies 86 and 90 are able to exit therethrough in the exit direction 108. By rotating the bracket 69, the wall 112 no longer forms a blocking wall.

The lid 64 can thereby be removed from the roller housing 14; the receptacles 84, 88 can be released from the associated holding bodies 86, 90 in relation to the exit direction 108; the holding bodies 86, 90 can exit the associated receiving spaces.

Further, the lid 64 can thereby be removed from the cleaning roller 46 and can be removed as a whole from the roller housing 14 (cf. FIG. 12).

In particular, the lid 84 and the cleaning roller 46 are loosely connected to one another.

After removal of the lid 64, the cleaning roller 46 can then be slid out of the roller receptacle 42.

To insert a new cleaning roller, same is inserted into the (empty) roller receptacle 42 and is brought into contact with the rotary bearing 58 by way of the counter element 60 of said cleaning roller.

On the lid 64, the pivotable bracket 69 is brought into its release position 118. Said bracket 69 is placed on the roller housing 14. The first opening 104 of the respective first receptacle 84, 88 is thereby positioned such that the associated first holding body 86 or the second holding body 90 dips into the associated receiving space 102.

After the dipping-in process, the bracket 69 is pivoted into its locking position 114. The first receptacle 84 and the second receptacle 88 are thereby rotated and the second opening 110 is thereby pivoted such that the corresponding first neck 98 and second neck 100, respectively, are positioned at said second opening 110. The wall 112 then acts as a blocking element.

It is also possible in principle for the locking position 114 to additionally be secured. For example, a spring-loading of the bracket 69 may be provided, and a spring force has to be overcome in order to bring the bracket 69 from the locking position 114 into the release position 118.

It is also possible, for example, for the pivot bearing 92 to be "stiff" in such a way that an increased application of force is required to reach the release position 118 from the locking position 114.

In a further example (FIGS. 13 to 16), provision is made for the cleaning roller 46' to be axially lockable to a lid 120. Otherwise, the cleaning machine is configured identically to the cleaning machine 10 and identical reference numerals are used for identical elements.

The cleaning roller 46' is configured basically identical to the cleaning roller 46. It additional comprises a pin 122 on a side facing away from the counter element 60.

Arranged on the lid 120 is a slider 124, which together with the pin 122 forms a locking device 126 for axially locking the lid 120 to the cleaning roller 46'.

The slider 124 has a recess 128 in which the pin 122 is immersed. In a locking position (cf. FIG. 16) the pin 122 is immersed in the recess 128. The slider 124 is thereby in such a displacement position that an exit of the pin 122 from the recess 128 is blocked. The cleaning roller 46' is thereby axially fixedly (in a direction parallel to the rotational axis 50) connected to the lid 120.

This locking position can be released by displacing the slider 124. The locking is thereby released and the pin 122 can exit the recess 128 on the lid 120. The cleaning roller 46' can thereby be released from the lid 120.

With respect to the fixing and locking of the lid 120 to the roller housing 14, this embodiment functions the same as described above.

In the embodiment in accordance with FIGS. 13 to 16, the cleaning roller 46' is not loosely mounted on the lid 120, rather an axial locking is possible.

To insert the cleaning roller 46' into the corresponding roller receptacle 42, first the cleaning roller 46' is locked to the lid 120 by the pin 122 being brought into the recess 128 and the slider 124 then being brought into its locking position.

Axial connection between the lid 120 and the cleaning roller 46' is thereby produced.

This axial connection hereby such that the cleaning roller 46' is rotatable relative to the lid 120. For this purpose, a corresponding rotary bearing 130 is arranged on the lid 120.

The cleaning roller 46' in this combination can then be slid into the roller receptacle 42.

The corresponding bracket 69 on the lid 120 is in its release position 118 and the holding bodies 86, 90 can then dip into their respective receiving spaces 102. By pivoting the bracket 69 into its locking position 114, a locking is achieved.

One proceeds accordingly in reverse to release the cleaning roller 46' from the roller housing 14.

Figure 14:
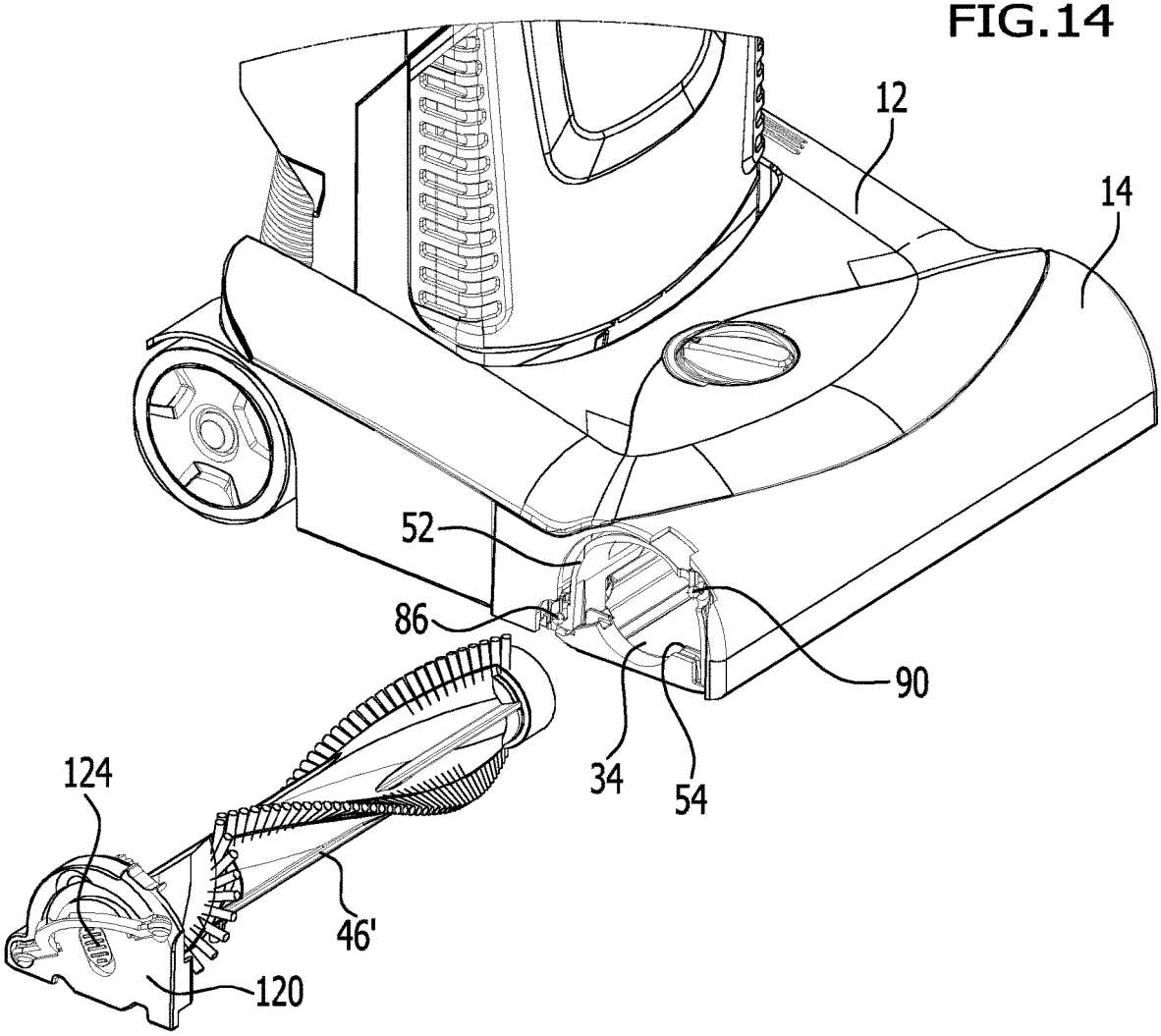
FIG. 14 shows a similar view as FIG. 13, a release position for the lid being shown and a cleaning roller being removed from the roller housing and the lid thereby being connected to the cleaning roller.
Figure 15:
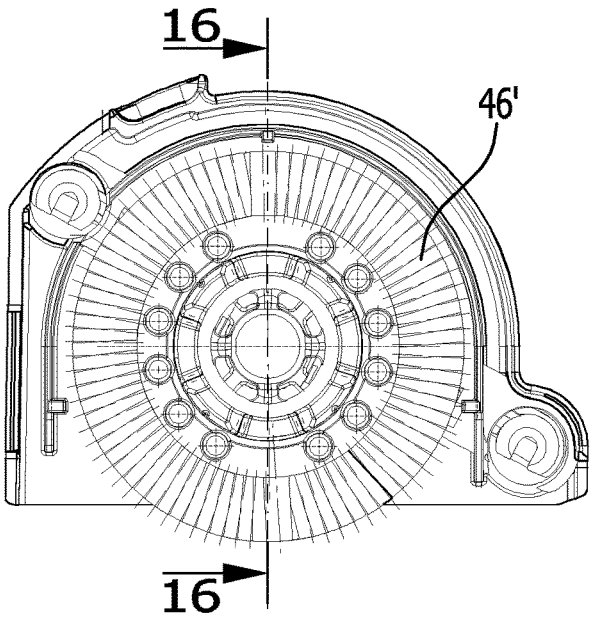
FIG. 15 shows a plan view of the lid with the cleaning roller.
Figure 16:
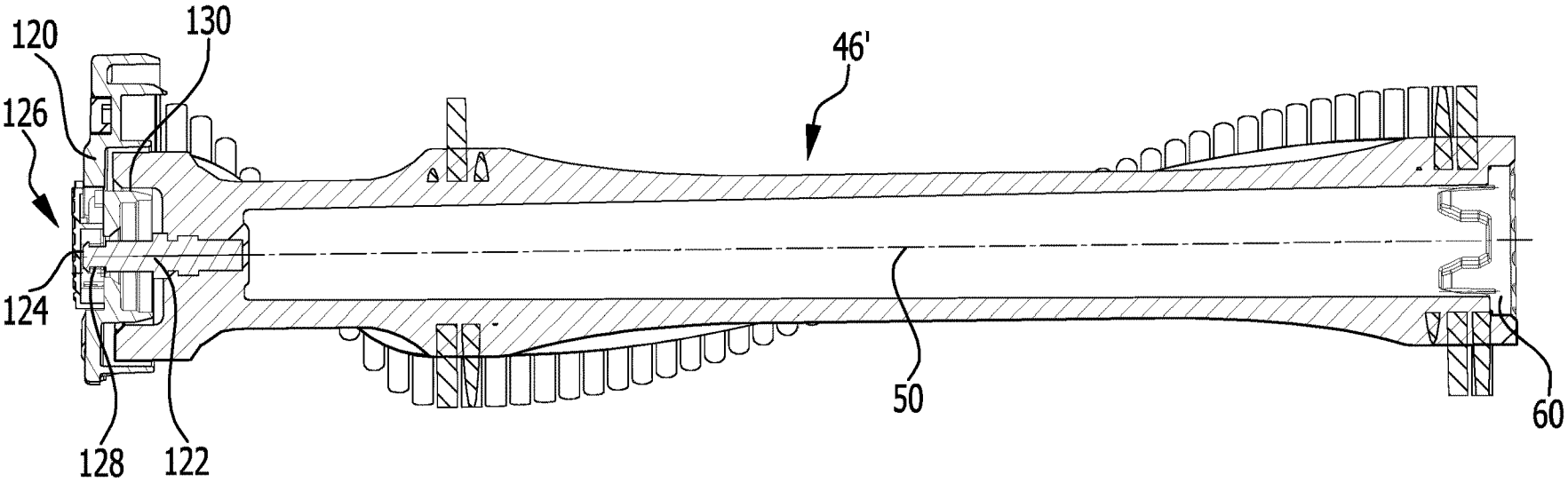
FIG. 16 shows a sectional view along line 16-16 in accordance with FIG. 15.

The combination of lid 120 and cleaning roller 46', which are axially connected to one another, is removed from the roller housing 14 (cf. FIG. 14). After removal, the lid 120 is then released from the cleaning roller 46' by means of a corresponding displacement of the slider 124 out of its locking position.

REFERENCE NUMERAL LIST

10 cleaning machine
12 floor head
14 roller housing
16 surface to be cleaned
18 wheel device
20 wheel
22 rolling device

24 holding rod device
26 handle
28 holding rod
30 housing
32 suction blower device
34 suction mouth
36 suction pipe
38 suction hose
40 holder
42 roller receptacle
44 front end
46 cleaning roller
46' cleaning roller
48 bristle arrangement
50 rotational axis
52 end wall
54 opening
56 wall
58 rotary bearing
60 counter element
62 drive motor
64 lid
66 rotary bearing
68 pivot axis
69 bracket
70 envelope plane
72 acute angle
74 outside
76 inside
78 first region
80 second region
82 third region
84 first receptacle
86 first holding body
88 second receptacle
90 second holding body
92 pivot bearing
94 first bearing region
98 second bearing region
100 first neck
100 second neck
102 receiving space
104 first opening
106 insertion direction
108 exit direction
110 second opening
112 wall
114 locking position
115 locking device
116 recess
118 release position
120 lid
122 pin
124 slider
126 locking device
128 recess
130 rotary bearing

The invention claimed is:

1. A cleaning machine, comprising:

at least one cleaning roller;

a roller housing having a roller receptacle for the at least one cleaning roller, wherein the at least one cleaning roller is exchangeably positioned on the roller housing and the roller receptacle has an opening to the outside;

a lid for closing the opening; and a locking device for fixing the lid to the roller housing, wherein at least one convex holding body is arranged on the roller housing, wherein a pivotable bracket is arranged on the lid, wherein at least one receptacle for the at least one holding body is arranged on the pivotable bracket, wherein in a release position of the pivotable bracket, the at least one holding body is able to selectively (i) engage into the associated receptacle and (ii) be removed from the associated receptacle and wherein in a locking position of the pivotable bracket, an exit of the holding body out of the associated receptacle is blocked;

wherein the at least one convex holding body is configured as a retaining ball.

2. The cleaning machine in accordance with claim 1, wherein the at least one receptacle has a receiving space for the associated holding body.

3. The cleaning machine in accordance with claim 2, wherein the receiving space has a spherical delimitation.

4. The cleaning machine in accordance with claim 2, wherein the receiving space has a first opening and a second opening, wherein the holding body is able to pass through the first opening and the holding body is not able to pass through the second opening.

5. The cleaning machine in accordance with claim 4, wherein the holding body sits on a neck, wherein in the locking position, the neck is positioned in the second opening.

6. The cleaning machine in accordance with claim 5, wherein by pivoting the pivotable bracket from the release position into the locking position when the holding body is positioned in the receiving space, the neck is positioned in the second opening.

7. The cleaning machine in accordance with claim 4, wherein the first opening and the second opening are connected to one another.

8. The cleaning machine in accordance with claim 1, wherein at least one first convex holding body and, at a distance from the first holding body, a second convex holding body are arranged on the roller housing, and in that a first receptacle for the first holding body and a second receptacle for the second holding body are arranged on the pivotable bracket.

9. The cleaning machine in accordance with claim 8, wherein a pivot bearing for a pivotability of the pivotable bracket is arranged between the first receptacle and the second receptacle.

10. The cleaning machine in accordance with claim 1, wherein in the release position, the pivotable bracket is oriented transversely to the lid.

11. The cleaning machine in accordance with claim 1, wherein in the locking position, the pivotable bracket is oriented at least approximately parallel to the lid.

12. The cleaning machine in accordance with claim 1, wherein a recess for accommodating the pivotable bracket in the locking position is arranged on the lid.

13. The cleaning machine in accordance with claim 1, wherein at least one of a dipping-in direction and an exit direction of the at least one holding body for the associated receptacle is oriented transversely to a pivot axis of the pivotable bracket.

14. The cleaning machine in accordance with claim 1, wherein a pivot angle of the pivotable bracket between the release position and the locking position is in the range between 70° and 110°.

15. The cleaning machine in accordance with claim 1, wherein the pivotable bracket has a first region at which a first receptacle is arranged, and a second region at which a second receptacle is arranged, and a third region which is located between the first region and the second region.

16. The cleaning machine in accordance with claim 15, wherein the third region is configured as an arc.

17. The cleaning machine in accordance with claim 15, wherein a pivot bearing is arranged or formed in at least one of the first region and the second region.

18. The cleaning machine in accordance with claim 1, wherein a drive motor is provided for a rotary drive of the at least one cleaning roller.

19. The cleaning machine in accordance with claim 1, wherein arranged on the lid is a bearing for the at least one cleaning roller for rotatably mounting the at least one cleaning roller.

20. The cleaning machine in accordance with claim 1, wherein when the lid is fixed to the roller housing, the lid covers the at least one holding body towards the outside.

21. The cleaning machine in accordance with claim 1, wherein the lid is completely removable from the roller housing.

22. The cleaning machine in accordance with claim 1, wherein the roller housing has an end wall associated with the roller receptacle, wherein the opening is formed on the end wall, and wherein the at least one convex holding body is arranged on the end wall.

23. The cleaning machine in accordance with claim 1, wherein at least one of the following is the case:

a pivot axis of the pivotable bracket is arranged transversely to a rotational axis of the at least one cleaning roller;

a pivot axis of the pivotable bracket is arranged at an acute angle to an envelope plane of the roller housing.

24. The cleaning machine in accordance with claim 1, wherein the roller receptacle has an opening towards an envelope plane.

25. The cleaning machine in accordance with claim 1, wherein a locking device is provided for releasably locking the at least one cleaning roller to the lid.

26. The cleaning machine in accordance with claim 25, wherein the locking device is configured for an axial locking between the lid and the at least one cleaning roller.

27. The cleaning machine in accordance with claim 25, wherein the locking device comprises a pin, which is arranged on the at least one cleaning roller, and has a movable slider, which is arranged on the lid, wherein when the slider is in locking engagement with the pin, an axial locking between the lid and the at least one cleaning roller is present.

28. The cleaning machine in accordance with claim 1, wherein the at least one cleaning roller is at least one of a brush roller and a textile roller.

29. The cleaning machine in accordance with claim 1, having a configuration as a floor cleaning machine.

30. The cleaning machine in accordance with claim 29, comprising at least one suction opening, which is formed on the roller receptacle.

* * * * *